US011735851B2

(12) United States Patent
Nakajima et al.

(10) Patent No.: US 11,735,851 B2
(45) Date of Patent: Aug. 22, 2023

(54) CONNECTOR WITH A CABLE HOLDER AND SOCKET FOR ENGAGING THE CABLE HOLDER

(71) Applicant: KYOCERA CORPORATION, Kyoto (JP)

(72) Inventors: Nobuyuki Nakajima, Tokyo (JP); Ryoichi Manabe, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 86 days.

(21) Appl. No.: 17/433,544

(22) PCT Filed: Feb. 21, 2020

(86) PCT No.: PCT/JP2020/007223

§ 371 (c)(1),
(2) Date: Aug. 24, 2021

(87) PCT Pub. No.: WO2020/175405

PCT Pub. Date: Sep. 3, 2020

(65) Prior Publication Data

US 2022/0158374 A1 May 19, 2022

(30) Foreign Application Priority Data

Feb. 26, 2019 (JP) ..... 2019-033377

(51) Int. Cl.
*H01R 12/77* (2011.01)

(52) U.S. Cl.
CPC ..... *H01R 12/778* (2013.01); *H01R 12/774* (2013.01)

(58) Field of Classification Search
None
See application file for complete search history.

(56) References Cited

U.S. PATENT DOCUMENTS 9,136,627 B2 * 9/2015 Miura ..... H01R 12/778
9,203,179 B2 * 12/2015 Ohyama ..... H01R 43/20

FOREIGN PATENT DOCUMENTS

| | | | |
|---|---|---|---|
| JP | S45-22462 | B1 | 7/1970 |
| JP | S6394917 | A | 4/1988 |
| JP | H02-16588 | U | 2/1990 |
| JP | 2003-092160 | A | 3/2003 |
| JP | 2012-178246 | A | 9/2012 |
| JP | 2017-033697 | A | 2/2017 |

* cited by examiner

*Primary Examiner* — Ross N Gushi
(74) *Attorney, Agent, or Firm* — Duane Morris LLP

(57) ABSTRACT

A connector (1) according to the present disclosure includes a holder (10) holding a cable (30) including a conductor (31) and an insulating coat (32) covering the conductor (31), and a socket (20) with which the holder (10) is to be engaged and including a contact (22). The holder (10) includes a base portion (11) holding the cable (30) by being integrally molded with the cable (30) and in which a portion of each of the insulating coat (32) and the conductor (31) of the cable (30) is embedded, and an extension portion (12) covering at least a portion of the conductor (31) and extending from the base portion (11) toward a side of connect with the socket (20). The holder (10) exposes a part of the conductor (31) of the cable (30) in contact with the contact (22) in an engaged state in which the holder (10) and the socket (20) are engaged with each other.

12 Claims, 12 Drawing Sheets

CONNECTOR WITH A CABLE HOLDER AND SOCKET FOR ENGAGING THE CABLE HOLDER

CROSS REFERENCES TO RELATED APPLICATIONS

The present application claims priority of Japanese Patent Application No. 2019-033377, filed on Feb. 26, 2019 in Japan, the entire disclosure of this application is incorporated herein by reference.

TECHNICAL FIELD

The present disclosure relates to a connector.

BACKGROUND ART

In a known connector, for electrically connecting a flat cable and a circuit board, a holder attached to an insertion end portion of the cable and a socket mounted on the circuit board are engaged with each other. For example, PTL 1 discloses a connector in which a holder having a one-piece structure is employed. The connector includes a flat-cable holder that can reduce the number of assembly steps and improve yield.

CITATION LIST

Patent Literature

PTL 1: Japanese Unexamined Patent Application 2017-033697

SUMMARY OF INVENTION

A connector according to one embodiment of the present disclosure includes:

a holder holding a cable including a conductor and an insulating coat covering the conductor; and a socket with which the holder is to be engaged and including a contact, in which the holder holds the cable by being integrally molded with the cable, the holder includes a base portion in which a portion of each of the insulating coat and the conductor of the cable is embedded, and an extension portion covering at least a portion of the conductor and extending from the base portion toward a side of connect with the socket, and the holder exposes, of the conductor of the cable, a part in contact with the contact in an engaged state in which the holder and the socket are engaged with each other.

DESCRIPTION OF EMBODIMENTS

Figure 1:
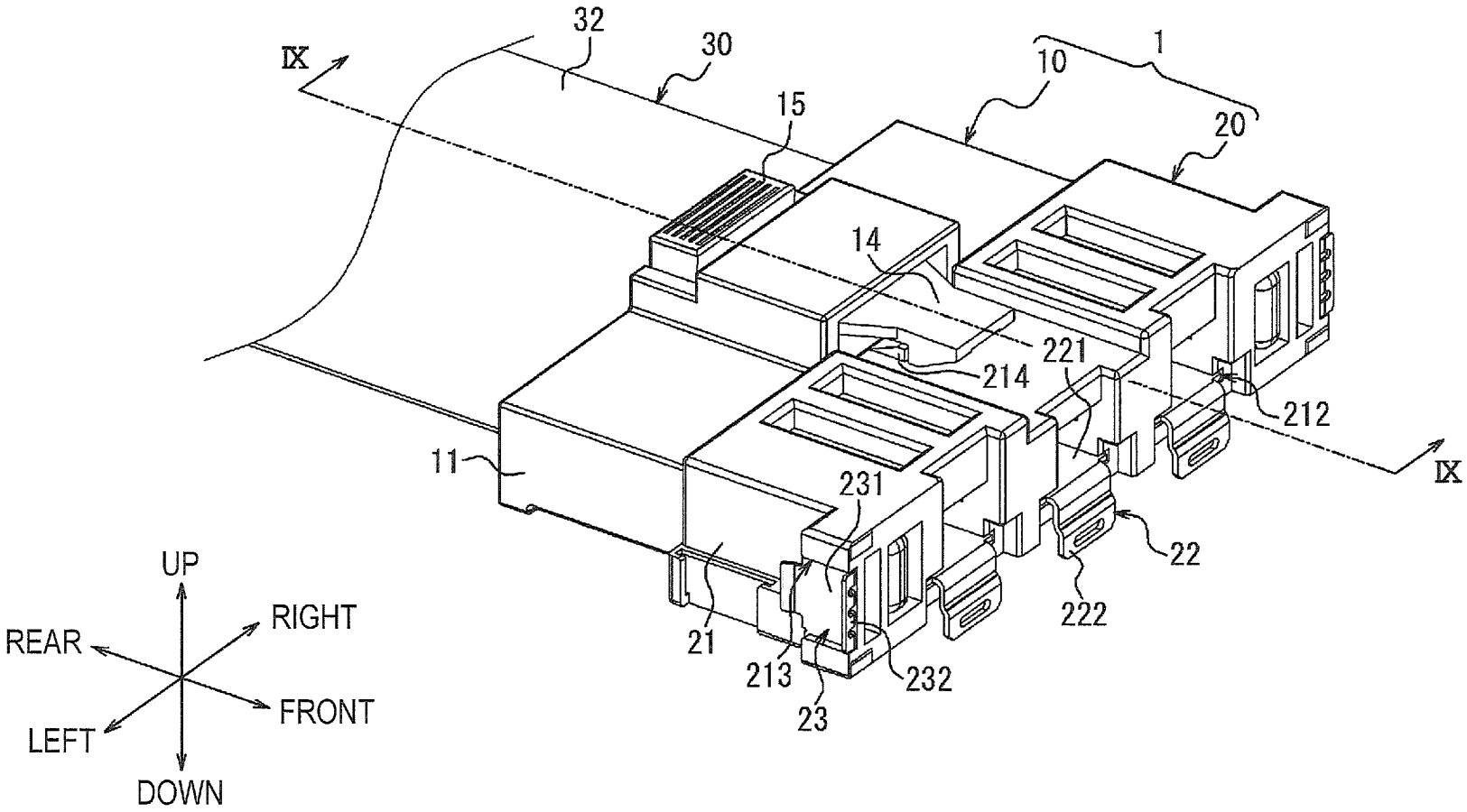
FIG. 1 is an external perspective view illustrating a connector and a flat cable according to a first embodiment.

In the connector described in PTL 1, a flat cable and a holder are configured as different bodies. An operator or the like is required to engage the holder with a socket in a state in which the flat cable is inserted into the holder so that the cable is temporarily held by the holder. In this case, a connection operation to be performed by an operator or the like with use of the connector includes a step of inserting the cable into the holder and a step of connecting the holder in a state of holding the cable to the socket, and efficiency in the operation is decreased. Moreover, due to the structure in which the cable is to be fitted into the holder, the cable has a possibility of coming off from the holder when an unexpected force is applied to the cable. Thus, a holding force is also concerned.

A connector according to one embodiment of the present disclosure improves efficiency in a connection operation and increases a holding force between a cable and a holder.

Hereinafter, one embodiment of the present disclosure will be described in detail with reference to the attached drawings. Front, rear, left, right, up, and down directions in the following description are based on the directions of the arrows in the drawings. Directions of the arrows are consistent with each other among different drawings. In the attached drawings, a circuit board on which a socket 20, which will be described later, is mounted is not illustrated for the purpose of simple illustration.

The "side of connect" used in the following description includes the front side as one example. The "side of the second surface" includes the lower side as one example. The "connect direction" includes the front-rear direction as one example. The "direction orthogonal to the connect direction" includes the left-right direction as one example. The "plate-thickness direction" includes the up-down direction as one example.

First Embodiment

Figure 2:
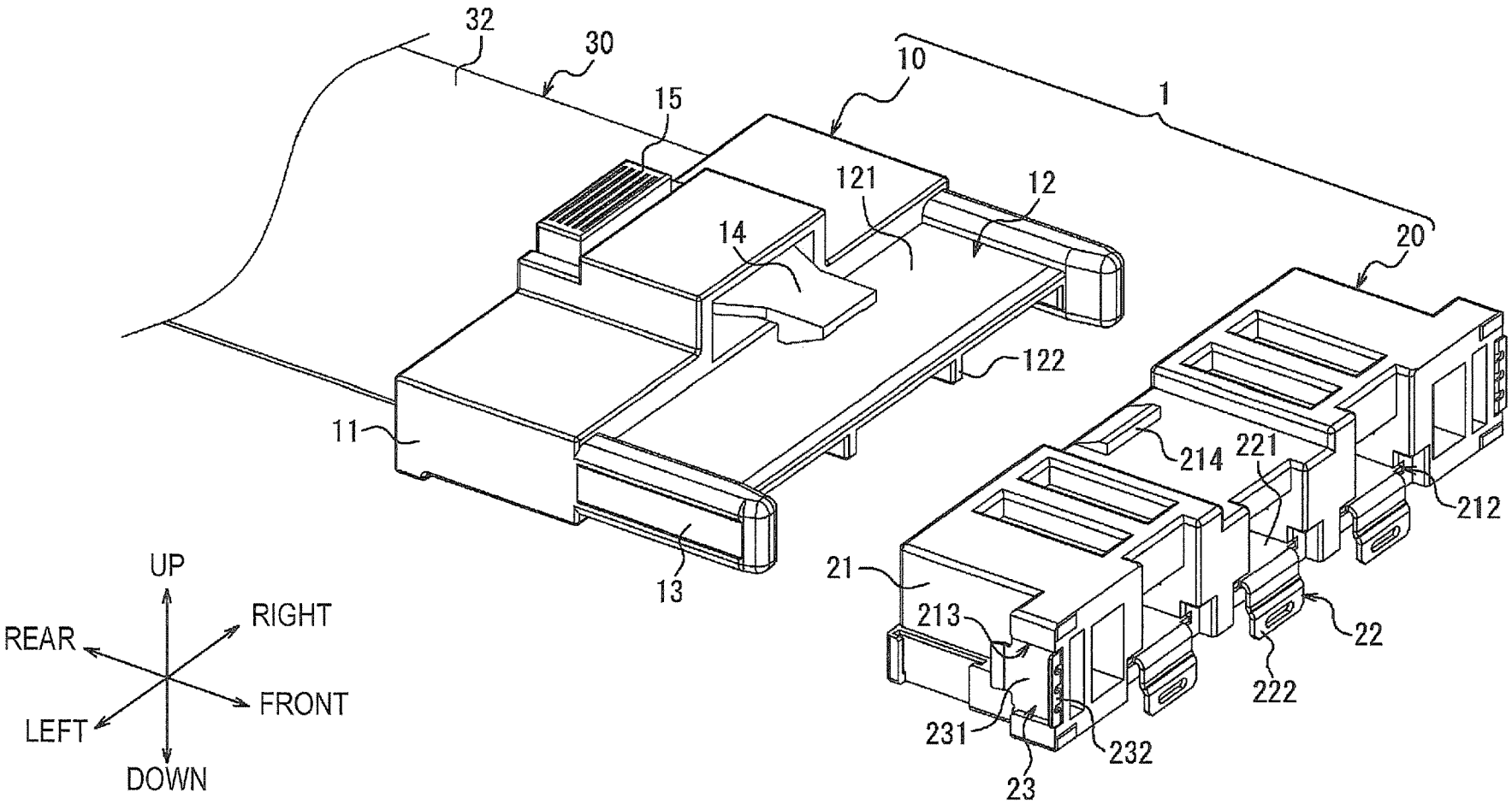
FIG. 2 is an external perspective view illustrating a separated state of the connector in FIG. 1.

With reference to FIG. 1 to FIG. 9, a first embodiment of the present disclosure will be mainly described. FIG. 1 is an external perspective view illustrating a connector 1 and a flat cable 30 according to the first embodiment. FIG. 2 is an external perspective view illustrating a separated state of the connector 1 in FIG. 1. The connector 1 includes a holder 10 integrally molded with the flat cable 30, and the socket 20 with which the holder 10 is engaged in the front-rear direction.

Figure 3:
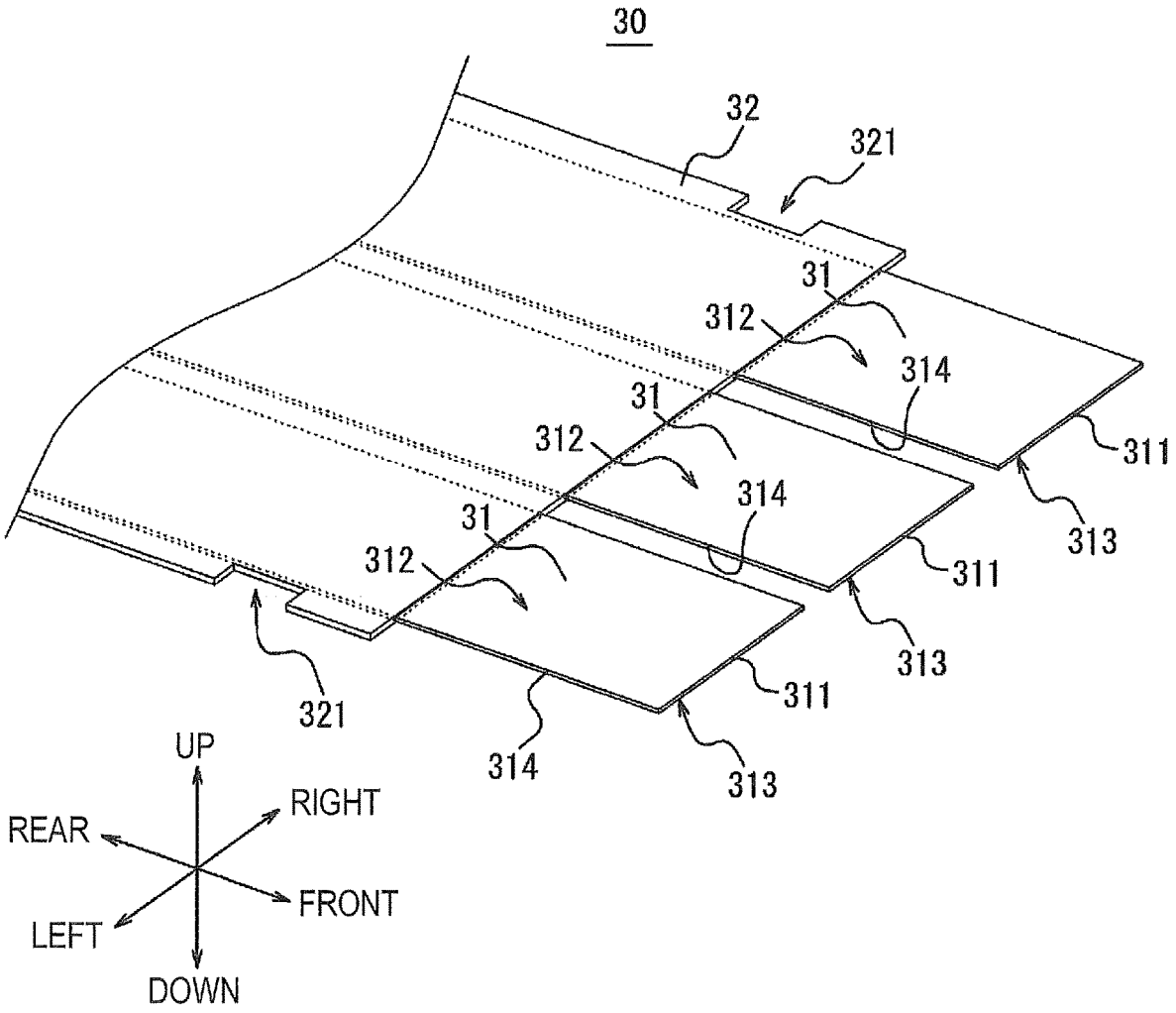
FIG. 3 is an external perspective view illustrating a flat cable in a state of not being integrally molded with a holder in FIG. 1.

FIG. 3 is an external perspective view illustrating the flat cable 30 in a state of not being integrally molded with the holder 10 in FIG. 1. One example of a configuration of the cable 30 will be mainly described with reference to FIG. 3. In FIG. 3, only a front end portion of the cable 30 is illustrated as one example, and the front end portion of the cable 30 illustrated in FIG. 3 will be mainly described below. The same description applies to a rear end portion of the cable 30.

The flat cable 30 integrally molded with the holder 10 of the connector 1 according to the first embodiment is, for example, a flexible flat cable (FFC). The cable 30 will be described below as a FFC but is not limited to the FFC. The cable 30 may be a flat cable electrically connected to the circuit board via the connector 1. For example, the cable 30 may be a flexible printed circuit board (FPC).

The cable 30 includes three conductors 31 and an insulating coat 32 covering the conductors 31. The insulating coat 32 includes a cover film integrally covering the three conductors 31 arranged in a state of being separated from each other in the left-right direction. The conductors 31 and the insulating coat 32 extend in the front-rear direction. At the front end portion of the cable 30, the three conductors 31 extend from the insulating coat 32 and are exposed to the outside. As illustrated in FIG. 3, a tip of each of the conductors 31 exposed from the insulating coat 32 constitutes a tip portion 311. Similarly, the upper surface of each of the conductors 31 exposed from the insulating coat 32 constitutes a first surface 312. The first surface 312 extends in the front, rear, left, and right directions. The first surface 312 is orthogonal to the plate thickness direction of the cable 30 and parallel to the connect direction in which the holder 10 and the socket 20 are engaged with each other. Similarly, the lower surface of each of the conductors 31 exposed from the insulating coat 32 constitutes a second surface 313. Similarly, both edges in the left-right direction of each of the conductors 31 exposed from the insulating coat 32 constitute edge portions 314. Both ends in the left-right direction of the front end of the insulating coat 32 constitute cutout portions 321 that are each cut out in an inwardly recessed shape.

Referring to FIG. 1 and FIG. 2, the circuit board on which the socket 20 is mounted is disposed in, for example, the up, down, left, and right directions in the drawings. For example, the cable 30 integrally molded with the holder 10 is inserted into the socket 20 in a direction perpendicular to the circuit board on which the socket 20 is mounted. The cable 30 is electrically connected to the circuit board by the integrally molded holder 10 being engaged with the socket 20 in the front-rear direction. Thus, the connector 1 achieves electrical connection between the cable 30 and the circuit board by two components of the holder 10 and the socket 20.

Figure 4:
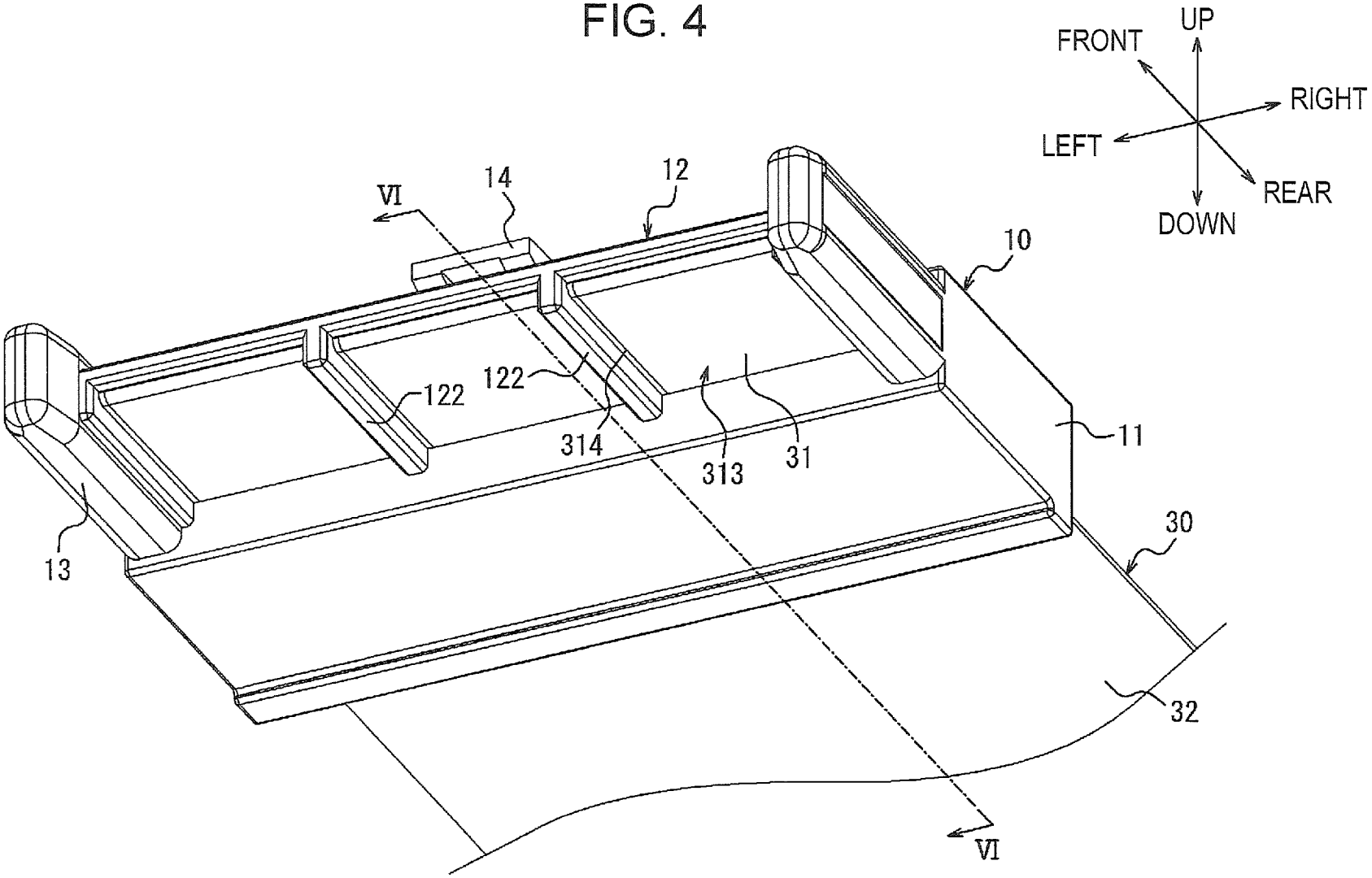
FIG. 4 is an external perspective view illustrating the holder and the cable in FIG. 1 in a state of being integrally molded with each other.
Figure 5:
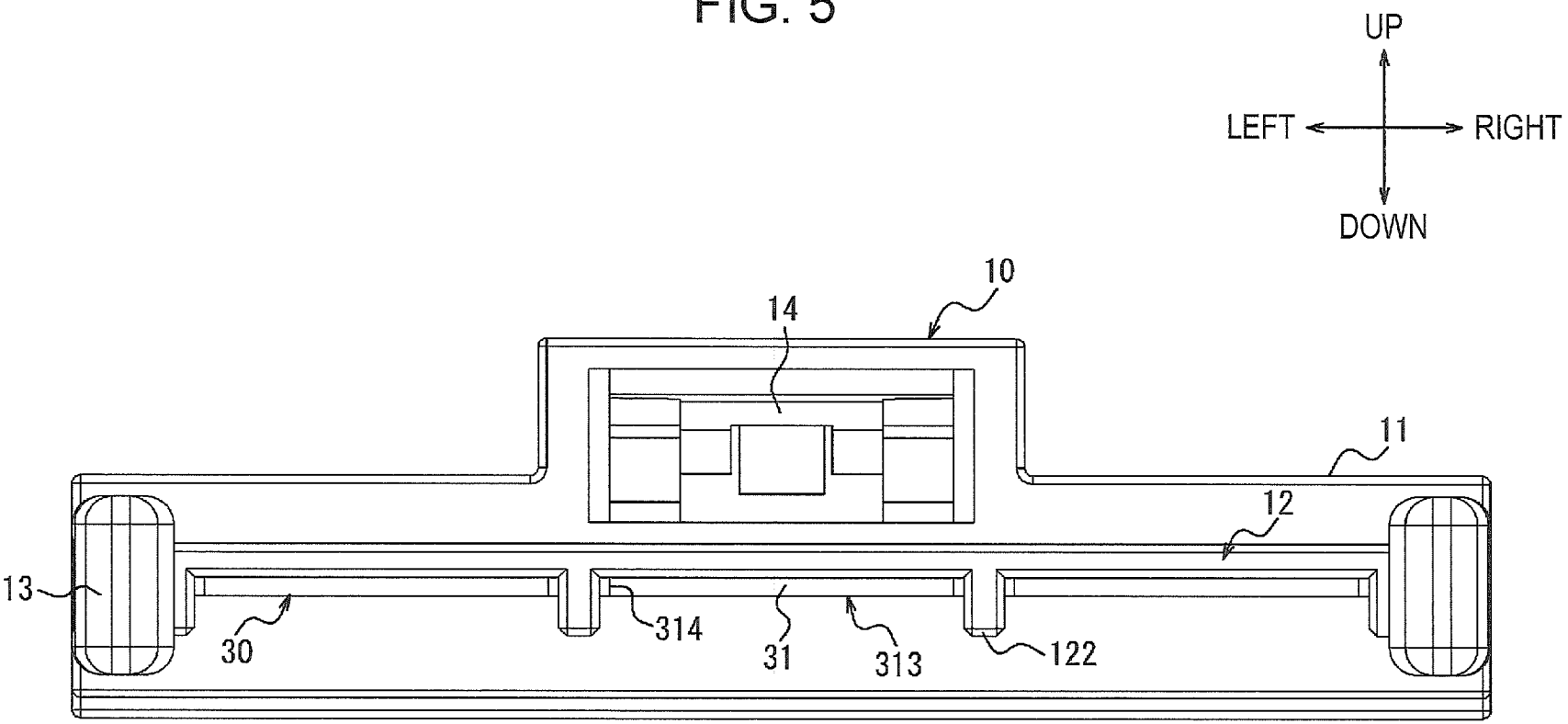
FIG. 5 is a front view of the holder in FIG. 1 integrally molded with the cable.
Figure 6:
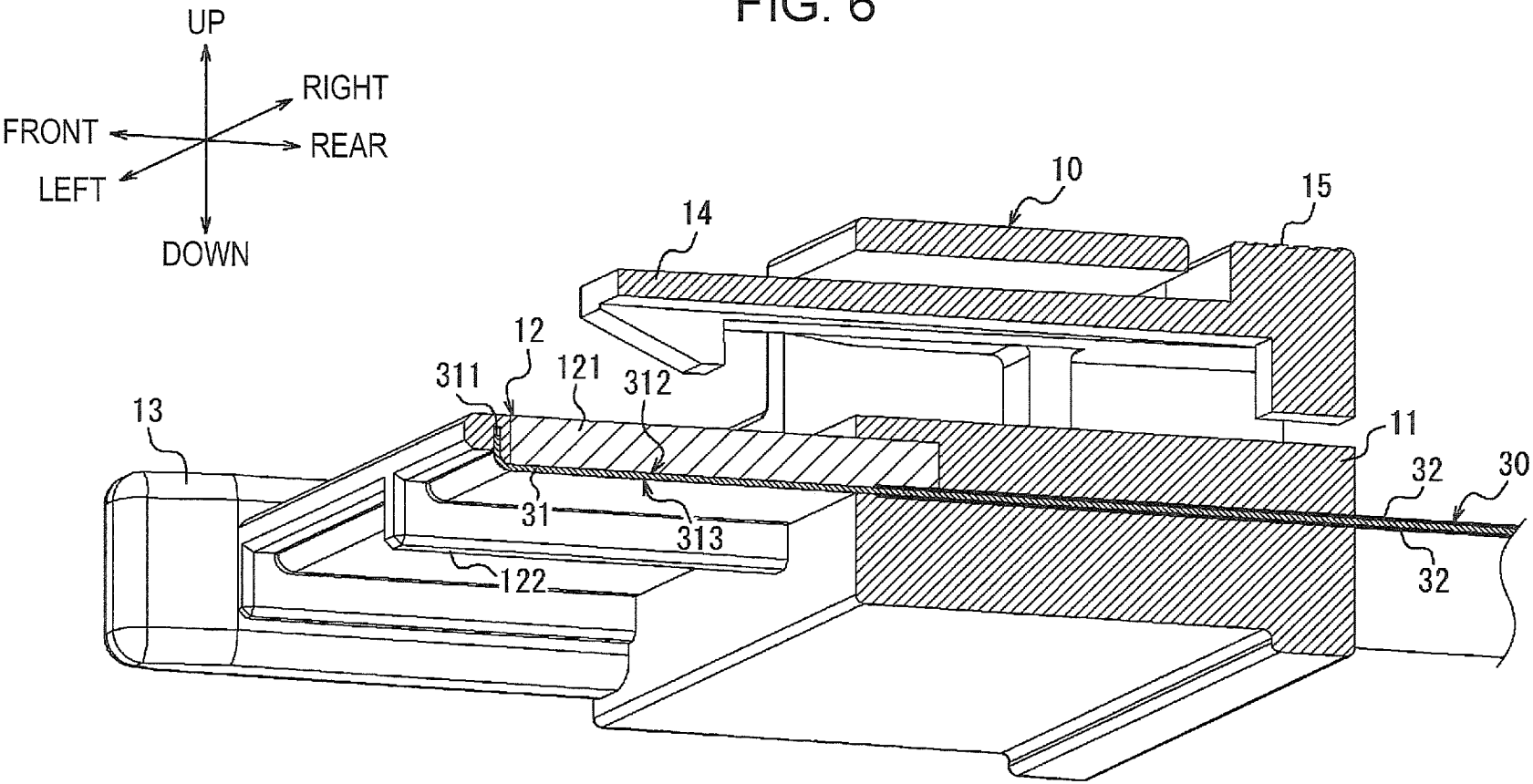
FIG. 6 is a sectional view along arrow line VI-VI in FIG. 4.

FIG. 4 is an external perspective view illustrating the holder 10 and the cable 30 in FIG. 1 in a state of being integrally molded. FIG. 5 is a front view of the holder 10 in FIG. 1 integrally molded with the cable 30. FIG. 6 is a sectional view along arrow line VI-VI in FIG. 4. With reference to FIG. 4 to FIG. 6, a configuration of the holder 10 integrally molded with the cable 30 will be mainly described.

The holder 10 is made of a synthetic resin material having insulation properties and heat-resistance properties. The holder 10 is integrally molded with the cable 30 by, for example, a molding method. The molding method includes, for example, methods such as insert molding, outsert molding, and the like. As illustrated in FIG. 4 to FIG. 6, the holder 10 includes a base portion 11 in which a portion of each of the insulating coat 32 of the cable 30 and the conductors 31 is embedded. The base portion 11 constitutes the rear half portion of the holder 10 and integrally covers a portion of each of the insulating coat 32 of the cable 30 and the conductors 31 exposed from the insulating coat 32.

As illustrated in FIG. 6, the holder 10 includes an extension portion 12 covering at least a portion of each of the conductors 31 of the cable 30 and extending from the base portion 11 toward the side of connect with the socket 20. More specifically, the extension portion 12 projects from the base portion 11 toward the tip portions 311 of the conductors 31 of the cable 30 and is in contact with the first surfaces 312 of the conductors 31 of the cable 30. The extension portion 12 covers the entirety of the first surfaces 312. The extension portion 12 includes a cover member 121 molded with a resin material that differs from the material of the base portion 11 integrally with the base portion 11. The cover member 121 is in contact with the first surfaces 312 of the conductors 31 of the cable 30 extending from the base portion 11 toward the side of connect with the socket 20. The cover member 121 covers the entirety of the first surfaces 312. In addition, the cover member 121 is also in contact, at a part thereof integrally molded with the base portion 11, with the upper surfaces of the conductors 31 of the cable 30 and the upper surface of the insulating coat 32.

The cover member 121 may be molded with a resin material that differs from the material of the base portion 11 integrally with the base portion 11. For example, a resin material that constitutes the cover member 121 may contain a material having high thermal conductivity and capable of efficiently dispersing heat that is generated by current flowing in the conductors 31 of the cable 30.

The holder 10 constitutes a surface opposite to the first surfaces 312 and exposes the second surfaces 313 of the conductors 31 of the cable 30 in contact with contacts 22, which will be described later, of the socket 20 in an engaged state in which the holder 10 and the socket 20 are engaged with each other. Thus, the holder 10 exposes, of the conductors 31 of the cable 30, parts that are in contact with the contacts 22, which will be later, in the engaged state in which the holder 10 and the socket 20 are engaged with each other. The holder 10 of the connector 1 exposes, in a state of being integrally molded with the cable 30, the conductors 31 of the cable 30. For example, the holder 10 of the connector 1 directly exposes the second surfaces 313 of the conductors 31 constituting the cable 30, differently from an existing connector that exposes, instead of the conductors 31 of the cable 30, a terminal or the like that is a separate component connected to the conductors 31 of the cable 30.

The conductors 31 of the cable 30 are bent at the tip portions 311 thereof on the side of the extension portion 12 of the holder 10 and are integral with the holder 10 in a state in which the tip portions 311 are embedded in the inside of the extension portion 12. More specifically, in the sectional view in FIG. 6, the conductors 31 of the cable 30 are integral with the holder 10 in a state in which the tip portions 311 of the conductors 31 are each bent upward in an L-shape and in which the bent parts are integrally covered by the extension portion 12.

As illustrated in FIG. 5, the extension portion 12 includes partition walls 122 that partition, among the plurality of conductors 31 of the cable 30 arranged in a direction orthogonal to the connect direction in which the holder 10 and the socket 20 are engaged with each other, the conductors 31 adjacent to each other. The partition walls 122 project from the extension portion 12 in the plate thickness direction of the conductors 31 by a length larger than the plate thickness of the conductors 31. More specifically, the partition walls 122 partition the conductors 31 adjacent to each other and project from the extension portion 12 on the outer side, that is, on the lower side of the second surfaces 313 of the conductors 31. The partition walls 122 project from the extension portion 12 by a projection amount depending on a creepage distance required for suppressing an electrical problem such as a short circuit due to a dielectric breakdown between the conductors 31 adjacent to each other. The partition walls 122 project from the extension portion 12 by a projection amount with which a minimum required creepage distance depending on a value of current flowing in the conductors 31 is obtained.

In FIG. 5, the edge portions 314 of the conductors 31 of the cable 30 in the direction orthogonal to the connect direction are not embedded in the inside of the partition walls 122 and are separated from the side surfaces of the partition walls 122 in the left-right direction with a resin material that constitutes a portion of the extension portion 12 being interposed between the edge portions 314.

As illustrated in FIG. 4, the holder 10 includes guide portions 13 projecting more than the extension portion 12 toward the side of connect with the socket 20 from both ends of the base portion 11 in the direction orthogonal to the connect direction in which the holder 10 and the socket 20 are engaged with each other. The front ends of the guide portions 13 are positioned on the side of connect with the socket 20 from the front end of the extension portion 12. The extension portion 12 is interposed between a left-right pair of the guide portions 13 such that the left-right pair of the guide portions 13 is continuous with the base portion 11 and the extension portion 12. The guide portions 13 project on the side of the second surfaces 313 more than the extension portion 12 in the plate thickness direction of the cable 30. More specifically, the lower ends of the guide portions 13 are positioned lower than the lower ends of the partition walls 122 of the extension portion 12.

As illustrated in FIG. 2, the holder 10 includes a lock portion 14 continuous with the base portion 11 at an upper portion of the base portion 11. The lock portion 14 is to be locked with a lock portion 214, which will be described later, of the socket 20 in the engaged state in which the holder 10 and the socket 20 are engaged with each other. The lock portion 14 includes, for example, a lock claw. The lock portion 14 is not limited to having such a configuration and may include a configuration that can realize the engaged state in which the holder 10 and the socket 20 are engaged with each other together, in cooperation with the lock portion 214, which will be described later, of the socket 20. For example, the lock portion 14 may include, instead of or in addition to a lock claw, a lock hole, a lock recess portion, and the like.

The holder 10 includes an operation portion 15 disposed at the lock portion 14 and releases locking between the lock portion 214, which will be described later, of the socket 20 and the lock portion 14. For example, the operation portion 15 displaces the tip portion of the lock claw of the lock portion 14 by a downward pressing force received from an operator, a manufacturing apparatus, or the like and releases locking between the lock portion 214, which will be described later, of the socket 20 and the lock portion 14.

Figure 7:
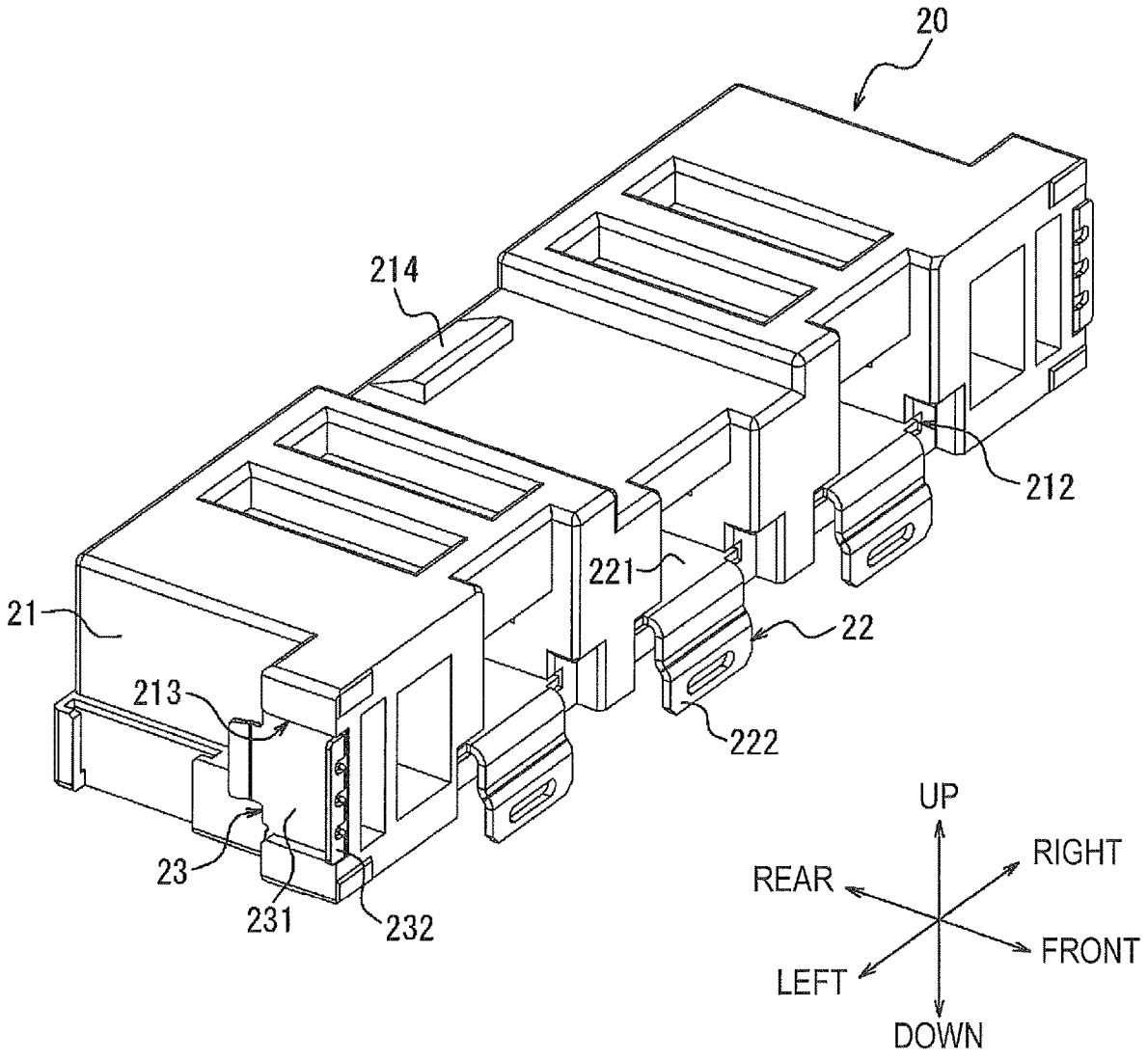
FIG. 7 is an external front perspective view illustrating only a socket in FIG. 1.
Figure 8:
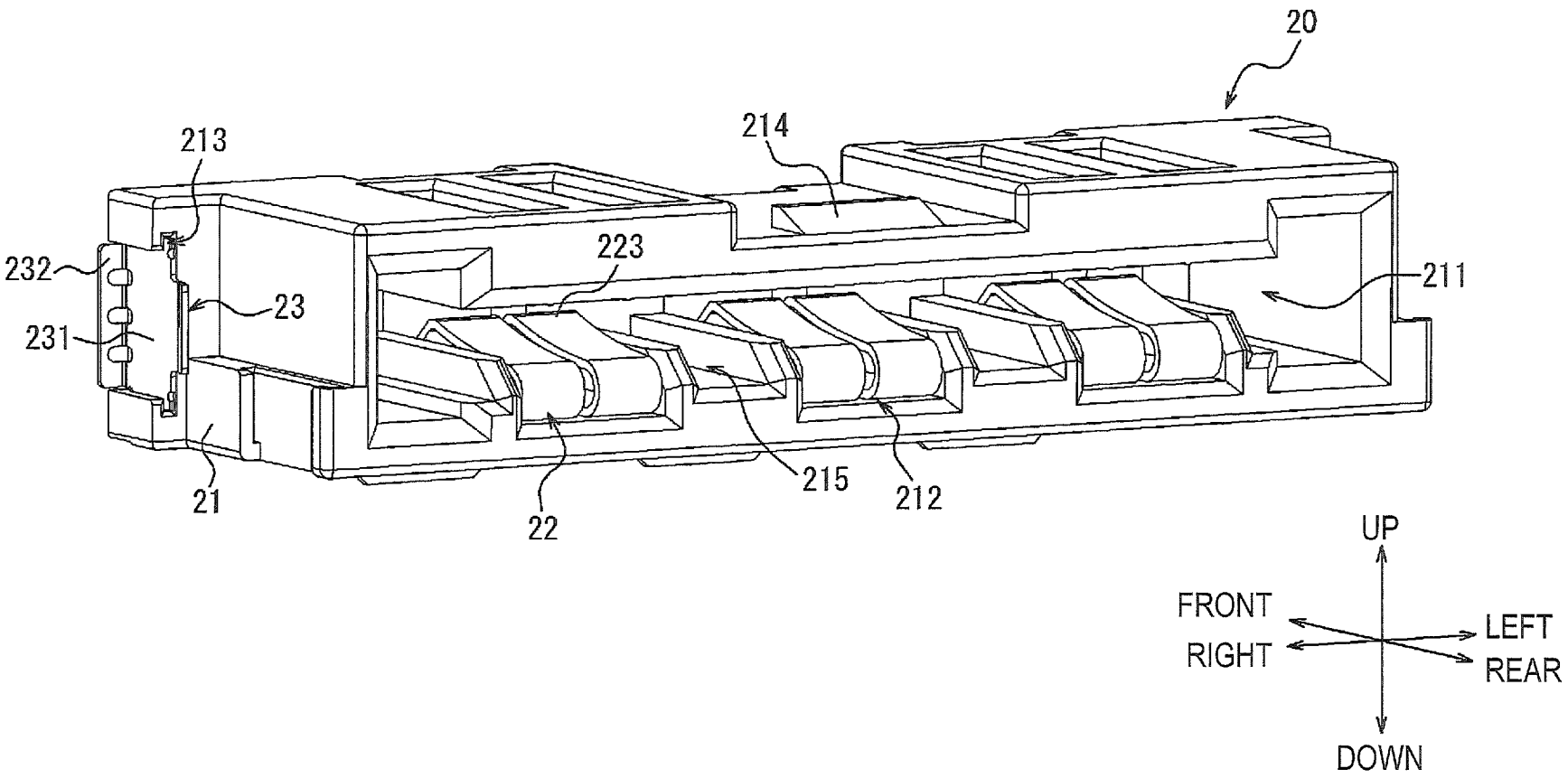
FIG. 8 is an external rear perspective view illustrating only the socket in FIG. 1.

FIG. 7 is an external front perspective view illustrating only the socket 20 in FIG. 1. FIG. 8 is an external rear perspective view illustrating only the socket 20 in FIG. 1. With reference to FIG. 7 and FIG. 8, a configuration of the socket 20 that is to be engaged with the holder 10 integrally molded with the cable 30 will be mainly described.

The socket 20 includes an insulator 21 constituting the outer frame, and the contacts 22 and metal fittings 23 that are attached to the insulator 21. The socket 20 is assembled as a result of, for example, the contacts 22 being press-fitted into the insulator 21 from the front to the rear and the metal fittings 23 being press-fitted into the insulator 21 from the rear to the front.

The insulator 21 is a rectangular cylindrical member made of a synthetic resin material having insulation properties and heat-resistance properties. As illustrated in FIG. 8, the insulator 21 includes an insertion groove 211 extending inwardly from the rear surface and recessed at almost the entirety of the inside thereof. The insertion groove 211 accommodates the extension portion 12 and the guide portions 13 of the holder 10 in the engaged state in which the holder 10 and the socket 20 are engaged with each other.

As illustrated in FIG. 7, the insulator 21 includes contact attachment grooves 212 each recessed at a lower portion on the front surface. The contacts 22 are press-fitted into the contact attachment grooves 212. The insulator 21 includes metal-fitting attachment grooves 213 recessed at front end portions on left and right both sides. The metal fittings 23 are press-fitted into the metal-fitting attachment grooves 213. The insulator 21 includes the lock portion 214 projecting at a rear center portion of the upper surface of the insulator 21. The lock portion 214 may include a configuration that can realize the engaged state in which the holder 10 and the socket 20 are engaged with each other, in cooperation with the lock portion 14 of the holder 10. For example, the lock portion 214 includes a lock projection that is locked with the lock portion 14 of the holder 10 in the engaged state in which the holder 10 and the socket 20 are engaged with each other.

As illustrated in FIG. 8, the insulator 21 includes, in the insertion groove 211, accommodation portions 215 disposed between the contact attachment grooves 212. More specifically, the accommodation portions 215 are interposed between a pair of the contact attachment grooves 212 in the left-right direction. The accommodation portions 215 are disposed such that parts corresponding to the partition walls 122 are recessed. The accommodation portions 215 accommodate the partition walls 122 of the holder 10 in the engaged state in which the holder 10 and the socket 20 are engaged with each other.

As illustrated in FIG. 7 and FIG. 8, the contacts 22 are, for example, thin plates of a copper alloy having spring elasticity and containing phosphor bronze, beryllium copper, or a titanium copper or a Corson copper alloy, the thin plates being molded into the illustrated shape by using a progressive mold (stamping), bending, and the like. After the surfaces of the contacts 22 are plated with nickel to dispose a base thereon, the surfaces of the contacts 22 are plated with gold, tin, or the like.

The socket 20 includes three contacts 22 in correspondence with the number of the conductors 31 of the cable 30. The three contacts 22 are attached to the contact attachment grooves 212 and are arranged in a state of being separated from each other in the left-right direction to be in contact with the three conductors 31 corresponding thereto in the engaged state in which the holder 10 and the socket 20 are engaged with each other.

The contacts 22 each include a base portion 221 constituting almost the entirety of the lower portion and extending in the front-rear direction. The contacts 22 each include a mount portion 222 extending downward from the front end portion of the base portion 221 by being bent in an L-shape.

The contacts 22 each include a contact portion 223 extending forward from the rear end portion of the base portions 221 by being bent in a U-shape.

The metal fittings 23 are thin plates of a metal material, the thin plates being molded into the illustrated shape by using a progressive mold (stamping), bending, and the like. The metal fittings 23 are attached to the metal-fitting attachment grooves 213 and arranged at the front end portions on left and right both sides of the insulator 21.

The metal fittings 23 each include a base portion 231 extending upward, downward, forward, and rearward. The metal fittings 23 each include a mount portion 232 extending outward in the left-right direction from a front end portion of the base portion 231 by being bent in an L-shape.

In the socket 20 having the above structure, the mount portions 222 of the contacts 22 are soldered to a circuit pattern on a mount surface of the circuit board. The mount portions 232 of the metal fittings 23 are soldered to a ground pattern and the like on the mount surface. Consequently, the socket 20 is mounted on the circuit board. For example, an electronic component separated from the socket 20 and including a CPU, a controller, a memory, and the like is mounted on the mount surface of the circuit board.

Figure 9:
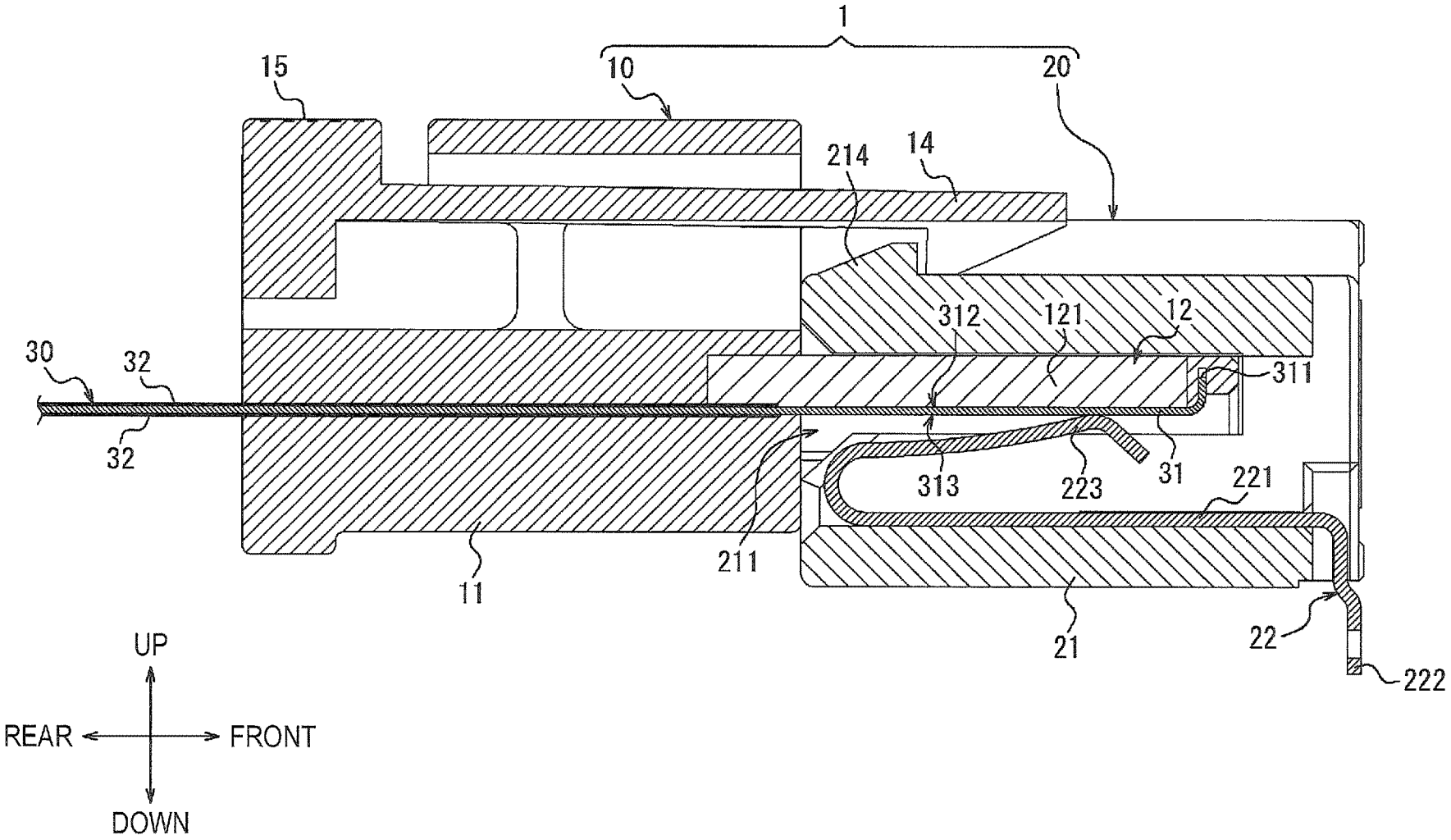
FIG. 9 is a sectional view along arrow line IX-IX in FIG. 1.

FIG. 9 is a sectional view along arrow line IX-IX in FIG. 1. With reference to FIG. 9, functions of constituent portions in the engaged state in which the holder 10 and the socket 20 are engaged with each other will be mainly described.

In the engaged state in which the holder 10 and the socket 20 are engaged with each other, the lock portion 14 of the holder 10 and the lock portion 214 of the socket 20 are locked with each other. At this time, the extension portion 12 and the guide portions 13 of the holder 10 are in the insertion groove 211 of the socket 20. The second surfaces 313 of the conductors 31 of the cable 30 exposed from the holder 10 are in contact with the contact portions 223 of the contacts 22 in the inside of the insertion groove 211 of the socket 20. Thus, in the connector 1, the conductors 31 constituting the cable 30 are in direct contact with the contacts 22 of the socket 20.

The connector 1 according to the first embodiment described above reduces the number of components relating to a connection operation and improves efficiency in the connection operation. More specifically, due to the flat cable 30 and the holder 10 being integrally molded, an operator or the like can omit an operation step of inserting the flat cable 30 into the holder 10 to temporarily hold the cable 30 in the holder 10. It is sufficient for an operator or the like to handle, as components relating to a connection operation, only the holder 10 integral with the cable 30, and the socket 20. Therefore, efficiency in the connection operation is improved compared with an existing connector with which an operator or the like handles the cable 30, the holder 10, and the socket 20 as separate components.

The flat cable 30 and the holder 10 that are integrally molded with each other improve the holding force with which the cable 30 is held by the holder 10. For example, the cable 30 that is embedded in the inside of the base portion 11 of the holder 10 improves the holding force of the holder 10 against a force with which the cable 30 is extracted from the holder 10. Consequently, it is possible to suppress unintended extraction of the cable 30 from the holder 10. As a result, breakage of the holder 10 and the cable 30 due to unintended extraction of the cable 30 is suppressed. Therefore, reliability of the connector 1 and the cable 30 as products are improved.

The holding force with which the cable 30 is held by the holder 10 is further increased by the cutout portions 321 being included in the cable 30 and by the cable 30, including the cutout portions 321, and the holder 10 being integrally molded with each other. For example, due to the cutout portions 321 of the cable 30 being embedded in the inside of the base portion 11 of the holder 10, the cutout portions 321 are caught by the base portion 11 when the cable 30 is attempted to be extracted from the holder 10. It is thus possible to suppress extraction of the cable 30 from the holder 10.

For example, regarding an existing connector with which an operator or the like handles a cable, a holder, and a socket as separate components, predetermined gaps are easily disposed during assembling of the connector both between the cable and the holder engaged with each other and between the holder and the socket engaged with each other. Consequently, the relative positions of a conductor of the cable and a contact of the socket may be displaced, which may cause noncontact between the conductor and the contact and may cause contact between another adjacent contact and the conductor of the cable. As a result, electrical connection may not be obtained correctly.

In the connector 1, due to the flat cable 30 and the holder 10 being integrally molded, no gap is disposed between the cable 30 and the holder 10, and the position of the cable 30 relative to the holder 10 is fixed. More specifically, the conductors 31 of the cable 30 are firmly fixed to the holder 10. Therefore, even in the engaged state in which the holder 10 and the socket 20 are engaged with each other, positional displacement of a contact part between the conductors 31 of the cable 30 and the contacts 22 of the socket 20 is suppressed compared with the above-described existing connector.

Due to parts of the conductors 31 of the cable 30 in contact with the contacts 22, that is, the second surfaces 313 being exposed from the holder 10, electrical contact with the contacts 22 of the socket 20 is easily obtained by directly using the conductors 31 of the cable 30. For example, there is no need for obtaining electrical connection with the contacts 22 of the socket 20 to use an additional component, such as a terminal, that differs from the conductors 31 of the cable 30. Thus, the number of components required for manufacturing the connector 1 is reduced. Therefore, efficiency in the production of the connector 1 is improved, and costs are reduced.

Due to the tip portions 311 of the conductors 31 of the cable 30 being embedded in the inside of the extension portion 12, it is possible to suppress corrosion, such as oxidation, even when broken sections of the tip portions 311 of the cable 30 are not plated because of, for example, a problem in manufacture and the like. Consequently, deterioration of the cable 30 is suppressed, and reliability of the connector 1, more specifically, the cable 30 attached to the holder 10 is increased as a product. Similarly, due to the tip portions 311 of the conductors 31 of the cable 30 being embedded in the inside of the extension portion 12, a possibility of the tip portions 311 of the cable 30 being turned up and peeling off from the holder 10 because of a factor is reduced. In addition, since the tip portions 311 of the conductors 31 are bent on the side of the extension portion 12, the holder 10 is easily guided into the socket 20 during connect between the holder 10 integrally molded with the cable 30 and the socket 20. Therefore, efficiency in an connect operation is improved.

Due to the holder 10 including the partition walls 122 that project from the extension portion 12 on the outer side of the second surfaces 313 of the conductors 31 of the cable 30, the holder 10 can suppress contact between, among the plurality of conductors 31 of the cable 30, the conductors 31 adjacent to each other. Consequently, electrical reliability of the connector 1 is increased. In addition, due to the partition walls 122 projecting to obtain an appropriate creepage distance, it is possible to cause large current to flow in the conductors 31. More specifically, when the partition walls 122 of the holder 10 are in the accommodation portions 215 of the socket 20 in the engaged state in which the holder 10 and the socket 20 are engaged with each other, it is possible to suppress contact between the conductors 31 adjacent to each other and obtain an appropriate creepage distance. Usually, the extension portion 12 is integrally molded to be flush with the second surfaces 313 of the conductors 31 because manufacture is easy. In the connector 1 according to the first embodiment, however, the partition walls 122 are intentionally disposed to cope with signal transmission with such large current. As a result, the partition walls 122 suppress electrical malfunctions, such as short circuit that occurs between the conductors 31 adjacent to each other and improve transmission characteristics of signal transmission with large current.

By being in contact with the first surfaces 312 of the conductors 31 of the cable 30, the cover member 121 can press the conductors 31 of the cable 30 from the upper side toward the lower side during integrally molding of the cable 30 and the holder 10. Consequently, the cover member 121 can suppress unintended movement and bending of the conductors 31 of the cable 30 in the up-down direction in a mold. Therefore, the cable 30 and the holder 10 are integrally molded easily, and efficiency in the production is improved. Due to the cover member 121 that constitutes the extension portion 12 covering the entirety of the first surfaces 312, following effects become more remarkable.

By being constituted by, for example, a resin material containing a material having high thermal conductivity, the cover member 121 can efficiently disperse heat that is generated by current flowing in the conductors 31 of the cable 30. Therefore, heat dissipation at the first surfaces 312 of the conductors 31 of the cable 30 is improved. As a result, malfunctions due to heat are also suppressed in signal transmission with large current, and reliability of the connector 1 as a product is improved.

The guide portions 13 project toward the side of connect with the socket 20 more than the extension portion 12 and project on the side of the second surfaces 313 more than the extension portion 12 in the plate thickness direction of the cable 30. Consequently, the guide portions 13 can suppress, even during insertion of the holder 10 integral with the cable 30 into the socket 20, breakage due to the second surfaces 313 of the conductors 31 of the cable 30 coming into contact with the insulator 21 of the socket 20, and the like. Thus, the guide portions 13 make an operation of inserting the holder 10 into the socket 20 easy and improve reliability of the connector 1 as a product.

The lock portion 14 of the holder 10 and the lock portion 214 of the socket 20 can firmly maintain the engaged state of the holder 10 and the socket 20 by being locked with each other in the engaged state in which the holder 10 and the socket 20 are engaged with each other. In addition, due to the holder 10 including the operation portion 15 at the lock portion 14, an operator or the like can easily separate the holder 10 and the socket 20 in the engaged state from each other by releasing locking between the lock portion 14 of the holder 10 and the lock portion 214 of the socket 20. Thus, the lock portion 14 of the holder 10 and the lock portion 214 of the socket 20 make operations of engaging and separating the holder 10 and the socket 20 easy.

It has been described that, in the first embodiment, the tip portions 311 of the conductors 31 of the cable 30 are embedded in the inside of the extension portion 12. The tip portions 311 are, however, not limited thereto. For example, the tip portions 311 of the conductors 31 of the cable 30 may be not embedded in the inside of the extension portion 12 if it is possible to easily apply plating on the broken sections of the tip portions 311 of the conductors 31 of the cable 30. The conductors 31 of the cable 30 may extend linearly from the base portion 11 without being bent at the tip portions 311 thereof on the side of the extension portion 12.

It has been described that, in the first embodiment, the conductors 31 of the cable 30 are integral with the holder 10 with the tip portions 311 being embedded in the inside of the extension portion 12 in a state of being bent at the tip portions 311 on the side of the extension portion 12. The conductors 31 are, however, not limited thereto. For example, the conductors 31 of the cable 30 may be integral with the holder 10 with the tip portions 311 being embedded in the inside of the extension portion 12 in a state of extending linearly from the base portion 11 without being bent at the tip portions 311 on the side of the extension portion 12.

It has been described that, in the first embodiment, the holder 10 includes the partition walls 122 projecting from the extension portion 12 on the outer side of the second surfaces 313 of the conductors 31 of the cable 30. The holder 10 is, however, not limited thereto. For example, as long as the electrical reliability of the connector 1 is maintained, the extension portion 12 may be flush with the second surfaces 313 of the conductors 31 of the cable 30 without including the partition walls 122 projecting on the outer side of the second surfaces 313.

It has been described that, in the first embodiment, the cover member 121 constituting the extension portion 12 is molded with a resin material that differs from the material of the base portion 11 integrally with the base portion 11. The cover member 121 is, however, not limited thereto. For example, the cover member 121 may be molded with the same resin material as the material of the base portion 11 integrally with the base portion 11.

It has been described that, in the first embodiment, the guide portions 13 project toward the side of connect with the socket 20 more than the extension portion 12 and project on the side of the second surfaces 313 more than the extension portion 12 in the plate thickness direction of the cable 30. The guide portions 13 are, however, not limited thereto. The guide portions 13 at the holder 10 may each have a shape that can make an operation of inserting the holder 10 into the socket 20 easy.

It has been described that, in the first embodiment, the engaged state and the separation state of the holder 10 and the socket 20 are realized by the lock portion 14 of the holder 10 including the operation portion 15, and the lock portion 214 of the socket 20. The engaged state and the separated state are, however, not limited thereto. The connector 1 may have a different configuration that makes an engaging operation and a separating operation easy.

Figure 10:
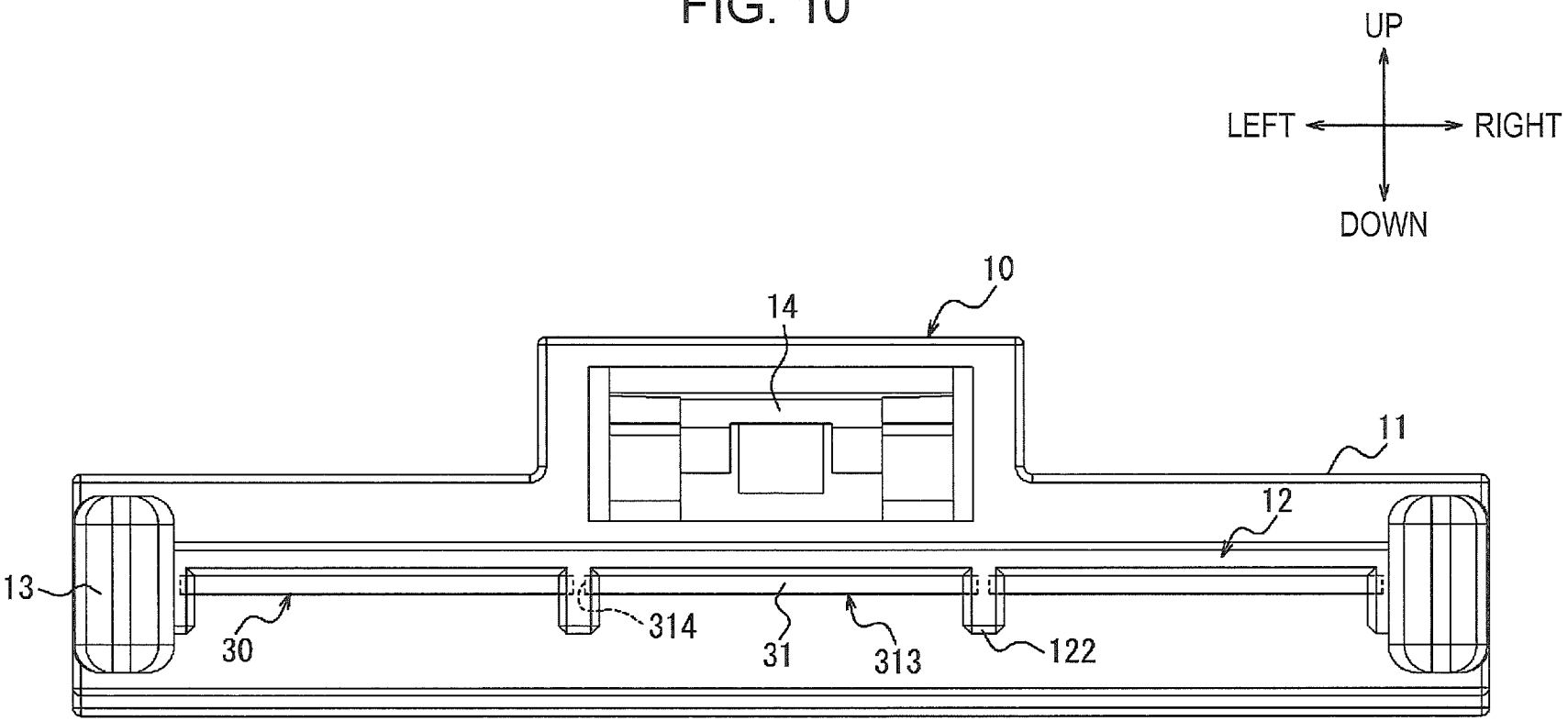
FIG. 10 is a front view corresponding to FIG. 5 and illustrating a modification of the holder in FIG. 1 integrally molded with the cable.

FIG. 10 is a front view corresponding to FIG. 5 and illustrating a modification of the holder 10 in FIG. 1 integrally molded with the cable 30. It has been described that, in the aforementioned first embodiment, the edge portions 314 of the conductors 31 of the cable 30 in the direction orthogonal to the connect direction are not embedded in the inside of the partition walls 122. The edge portions 314 are, however, not limited thereto. As illustrated in FIG. 10, the edge portions 314 of the conductors 31 of the cable 30 may be embedded in the inside of the partition walls 122. Consequently, the conductors 31 of the cable 30 are more firmly fixed to the holder 10. Therefore, even in the engaged state in which the holder 10 and the socket 20 are engaged with each other, positional displacement of the contact part between the conductors 31 of the cable 30 and the contacts 22 of the socket 20 is further suppressed. In addition, the holding force with which the conductors 31 are held by the holder 10 is improved, and thus, a possibility of, for example, the conductors 31 being turned up and peeling from the holder 10 is reduced.

Figure 11:
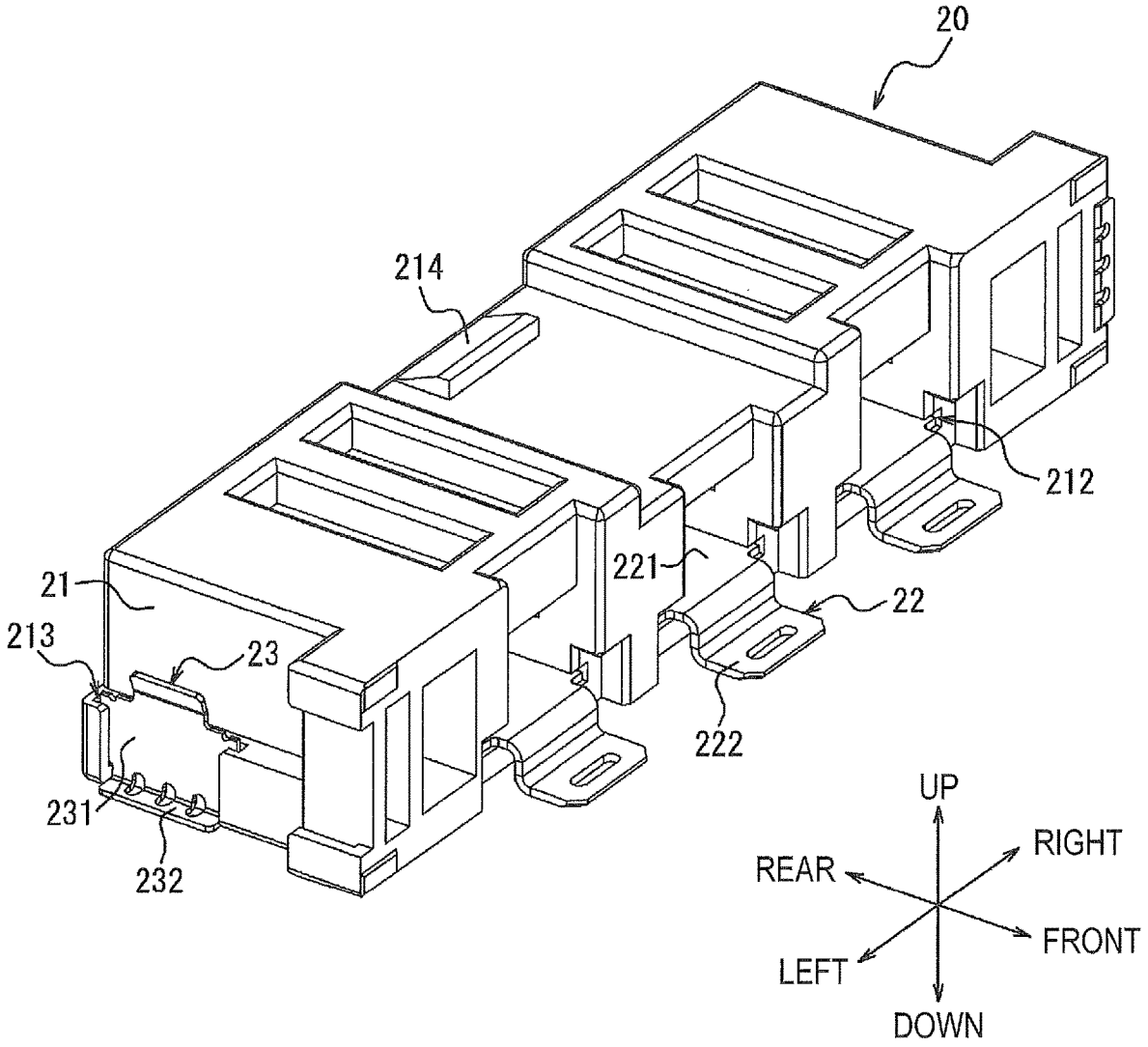
FIG. 11 is an external perspective view corresponding to FIG. 7 and illustrating a modification of the socket in FIG. 1.

FIG. 11 is an external perspective view corresponding to FIG. 7 and illustrating a modification of the socket 20 in FIG. 1. It has been described that, in the aforementioned first embodiment, the cable 30 integrally molded with the holder 10 is to be inserted into the socket 20 in a direction perpendicular to the circuit board on which the socket 20 is mounted. The cable 30 is, however, not limited thereto. As illustrated in FIG. 11, the circuit board on which the socket 20 is mounted may be arranged in, for example, the front, rear, left, and right directions in FIG. 11. The cable 30 integrally molded with the holder 10 may be inserted into the socket 20 in a direction parallel to the circuit board on which the socket 20 is mounted.

Second Embodiment

Figure 12:
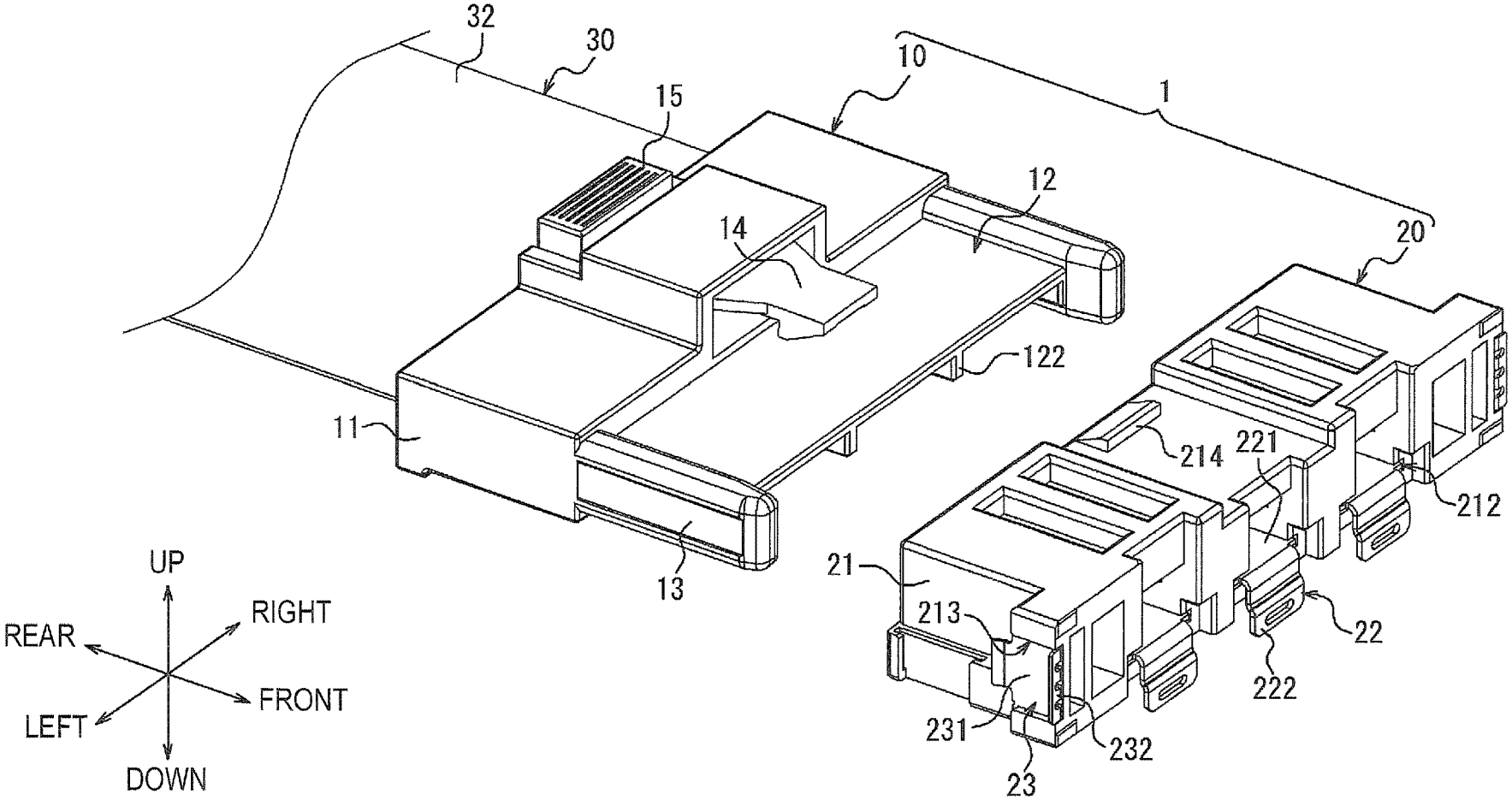
FIG. 12 is an external perspective view corresponding to FIG. 2 and illustrating a connector and a flat cable according to a second embodiment.

With reference to FIG. 12, a second embodiment of the present disclosure will be mainly described. FIG. 12 is an external perspective view corresponding to FIG. 2 and illustrating the connector 1 and the flat cable 30 according to the second embodiment. The connector 1 according to the second embodiment differs from that in the first embodiment in terms of the extension portion 12 not including the cover member 121. Other configurations, functions, effects, modifications, and the like are the same as those in the first embodiment, and corresponding description also applies to the connector 1 according to the second embodiment. The same constituent portions as those in the first embodiment are given the same signs and will not described below. Features that differ from those in the first embodiment will be mainly described.

In the second embodiment, the extension portion 12 is made of the same resin material as the material of the base portion 11 and is continuous with the base portion 11. For example, in the second embodiment, the extension portion 12 may be molded with the same resin material integrally with the cable 30 in one step together with all the other constituent portions including the base portion 11. The holder 10 and the cable 30 are not limited thereto and may be integrally molded with each other by a method. For example, only the base portion 11 is first integrally molded with the cable 30, and thereafter, all the other constituent portions including the extension portion 12 made of the same resin material as the material of the base portion 11 may be integrally molded with the cable 30. More specifically, the step of integrally molding the holder 10 and the cable 30 may include a first step of integrally molding only the base portion 11 with the cable 30, and a second step of integrally molding all the other constituent portions including the extension portion 12 made of the same resin material as the material of the base portion 11 with the cable 30. Thus, by integrally molding the holder 10 and the cable 30 in two steps, it is possible to position the cable 30 relative to the base portion 11 of the holder 10 in the first step and, in a state in which the position of the cable 30 is fixed at a certain degree, integrally mold the entirety of the holder 10 with the cable 30 in the second step. Therefore, the cable 30 and the holder 10 are integrally molded easily, and efficiency in the production is improved.

The connector 1 according to the second embodiment described above can reduce the number of components required for performing an operation of integrally molding due to the extension portion 12 not including the cover member 121. Therefore, the cable 30 and the holder 10 are integrally molded easily, and efficiency in the production of the connector 1 is improved.

In the second embodiment, as illustrated in FIG. 12, the extension portion 12 is continuous with the base portion 11 to cover the entirety of the conductors 31 of the cable 30. The extension portion 12 is, however, not limited thereto. For example, the extension portion 12 may have one or more through holes. At the through holes, the first surfaces 312 of the conductors 31 of the cable 30 are exposed from the holder 10.

Due to the extension portion 12 having such through holes, it is possible, when integrally molding the cable 30 and the holder 10, to directly press the conductors 31 of the cable 30 through the through holes from the upper side toward the lower side by using a tool usable for the through holes. Consequently, the cover member 121 can suppress unintended movement and bending of the conductors 31 of the cable 30 in the up-down direction in a mold. Therefore, the cable 30 and the holder 10 are integrally molded easily, and efficiency in the production is improved. In addition, due to the extension portion 12 having the through holes, it is possible to efficiently disperse, on the side of the first surfaces 312 of the conductors 31, heat that is generated by current flowing in the conductors 31 of the cable 30. Therefore, heat dissipation at the first surfaces 312 of the conductors 31 of the cable 30 is improved. As a result, malfunctions due to heat are also suppressed in signal transmission with large current, and reliability of the connector 1 as a product is improved.

It is apparent for a person skilled in the art that the present disclosure can be realized in predetermined different forms other than the above-described embodiments without departing from the spirit thereof or the essential features thereof. Therefore, the previous description is exemplary and not limited thereto. The scope of the disclosure is defined by the attached claims, not by the previous description. Among all of changes, some changes within a scope equivalent to the scope of the disclosure should be included therein.

For example, shapes, arrangement, directions, numbers, and the like of the above-described constituent portions are not limited to the contents of the above description and illustrations of the drawings. The shapes, arrangement, directions, numbers, and the like of the constituent portions may be configured in any manner as long as functions thereof can be realized.

It has been described above that, at the front end portions of the cable 30, three conductors 31 extend from the insulating coat 32 and are exposed to the outside. The conductors 31 are, however, not limited thereto. The cable 30 may be configured in a state in which only the second surfaces 313 are exposed and in which all of the constituent portions other than the second surfaces 313 are covered by the insulating coat 32.

Reference Signs List

1 connector
10 holder

11 base portion
12 extension portion
121 cover member
122 partition wall
13 guide portion
14 lock portion (second lock portion)
15 operation portion
20 socket
21 insulator
211 insertion groove
212 contact attachment groove
213 metal-fitting attachment groove
214 lock portion (first lock portion)
215 accommodation portion
22 contact
221 base portion
222 mount portion
223 contact portion
23 metal fitting
231 base portion
232 mount portion
30 cable
31 conductor
311 tip portion
312 first surface
313 second surface
314 edge portion
32 insulating coat
321 cutout portion

The invention claimed is:

1. A connector comprising:

a holder holding a cable comprising a conductor and an insulating coat covering the conductor; and a socket with which the holder is to be engaged and comprising a contact, wherein the holder holds the cable by being integrally molded with the cable, the holder comprises a base portion in which a portion of each of the insulating coat and the conductor of the cable is embedded, and an extension portion covering at least a portion of the conductor and extending from the base portion toward a side of connect with the socket, wherein:

the holder exposes, of the conductor of the cable, a part in contact with the contact in an engaged state in which the holder and the socket are engaged with each other, the extension portion comprises a partition wall that partitions, among the plurality of conductors of the cable arranged in a direction orthogonal to a connection direction in which the holder and the socket are engaged with each other, one conductor from an adjacent conductor, and the partition wall is formed between an edge portion of the one conductor and an edge portion of the adjacent conductor in the connection direction.

2. The connector according to claim 1, wherein the extension portion is in contact with a first surface of the conductor of the cable extending from the base portion toward the side of connect with the socket, and the holder exposes a second surface opposite to the first surface of the conductor of the cable in contact with the contact in the engaged state.

3. The connector according to claim 2, wherein the extension portion covers entirety of the first surface of the conductor.

4. The connector according to claim 1, wherein the conductor of the cable is integral with the holder in a state in which a tip portion of the conductor is embedded in an inside of the extension portion.

5. The connector according to claim 4, wherein the conductor of the cable is bent at the tip portion on a side of the extension portion.

6. The connector according to claim 1, wherein the partition wall projects from the extension portion on an outer side of the part of the conductor in contact with the contact.

7. The connector according to claim 1, wherein the edge portion of the conductor of the cable in the direction orthogonal to the connect direction is embedded in an inside of the partition wall.

8. The connector according to claim 1, wherein the socket comprises an accommodation portion that accommodates the partition wall in the engaged state.

9. The connector according to claim 1, wherein the extension portion comprises a cover member molded with a resin material that differs from a material of the base portion integrally with the base portion, and the cover member covers at least a portion of the conductor of the cable.

10. The connector according to claim 1, wherein the holder comprises a guide portion projecting more than the extension portion from each of both ends of the base portion in a direction orthogonal to a connect direction in which the holder and the socket are engaged with each other toward the side of connect with the socket.

11. The connector according to claim 10, wherein the guide portion projects on a side of the part of the conductor in contact with the contact more than the extension portion in a plate thickness direction of the cable.

12. The connector according to claim 1, wherein the socket comprises a first lock portion, and the holder comprises a second lock portion that is continuous with the base portion and to be locked with the first lock portion in the engaged state, and an operation portion that is disposed at the second lock portion and releases locking between the first lock portion and the second lock portion.

* * * * *